US007707678B2

(12) United States Patent
Major

(10) Patent No.: US 7,707,678 B2
(45) Date of Patent: May 4, 2010

(54) MULTIPLE SHAPE CHANGING ROLLER UNIT

(76) Inventor: Willis Gerald Major, P.O. Box 57, Rochester, NY (US) 14546

( * ) Notice: Subject to any disclaimer, the term of this patent is extended or adjusted under 35 U.S.C. 154(b) by 99 days.

(21) Appl. No.: 12/011,313

(22) Filed: Jan. 25, 2008

(65) Prior Publication Data

US 2009/0188065 A1 Jul. 30, 2009

(51) Int. Cl.
*B05C 17/02* (2006.01)

(52) U.S. Cl. ..... 15/230.11; 492/13; 492/19

(58) Field of Classification Search ..... 15/230.11; 492/13, 19

See application file for complete search history.

(56) References Cited

U.S. PATENT DOCUMENTS 2,035,127 A * 3/1936 Hinton ..... 101/329
2,813,292 A 11/1957 McIendon
2,824,328 A 12/1958 Bedford
3,358,312 A 12/1967 Parr
4,644,604 A 2/1987 Kierce
5,035,022 A 7/1991 Iuliano et al.
6,219,877 B1 * 4/2001 Lowrey et al. ..... 15/230.11
6,957,470 B2 10/2005 Rivadeneira

* cited by examiner

*Primary Examiner*—Mark Spisich

(57) ABSTRACT

A "multiple shape changing roller unit" comprising a slotted patterned frame handle and one of more roller cover & rod assemblies, that an operator will use to surround and act on the entire surface area of multisided objects comprising bars, posts, poles, shafts, spindles, railings, supports, and columns, while the operator is positioned on only one side of said multisided objects for purposes comprising painting, staining, dusting, polishing, striping, sanding, cleaning, wiping off or applying liquid and powder chemicals, wherein the slotted patterned handle has a uninterrupted or interrupted pattern configuration used for retaining the rod of the roller cover & rod assemblies to prevent movement while the unit is in use.

4 Claims, 21 Drawing Sheets

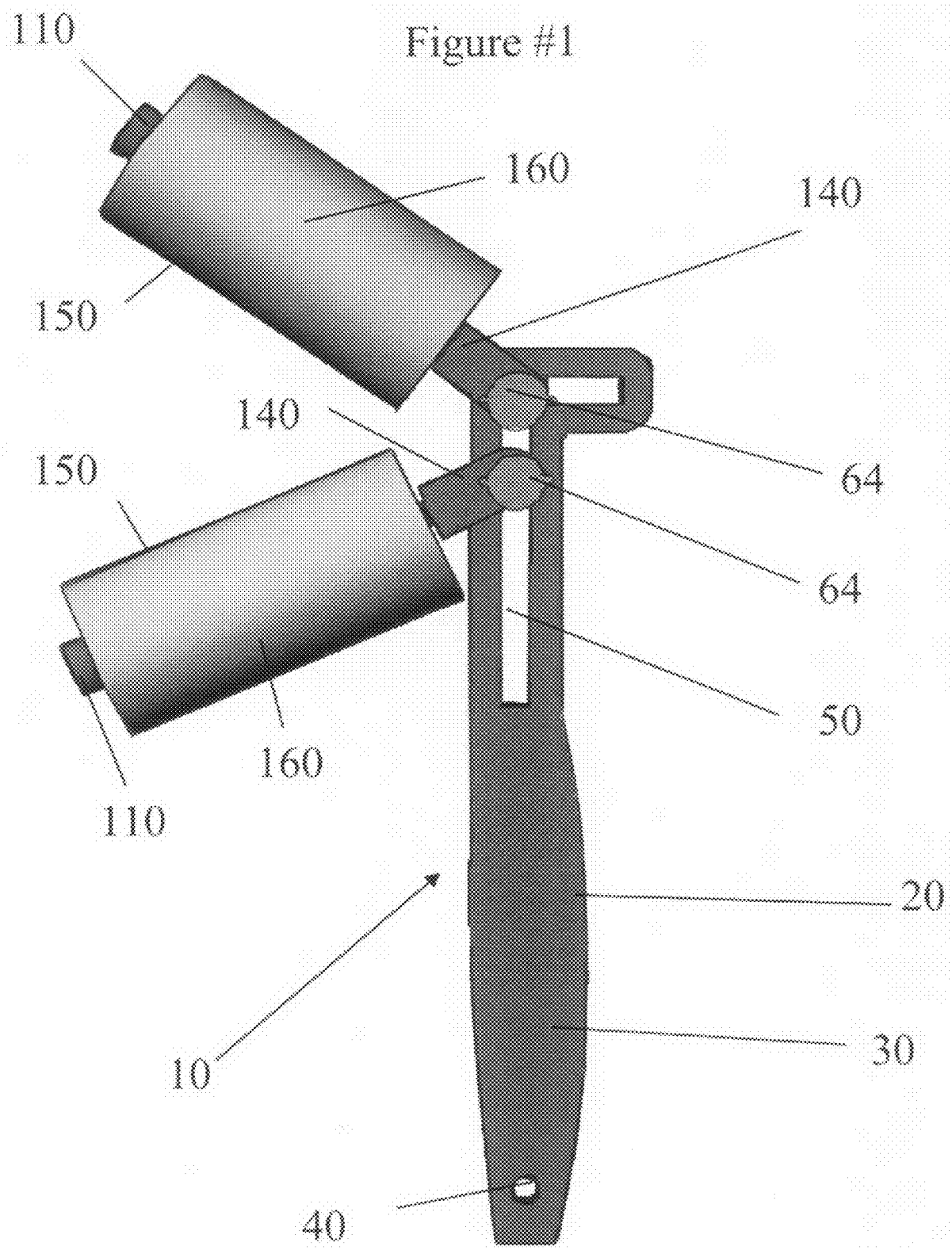
Figure #1

Figure #2
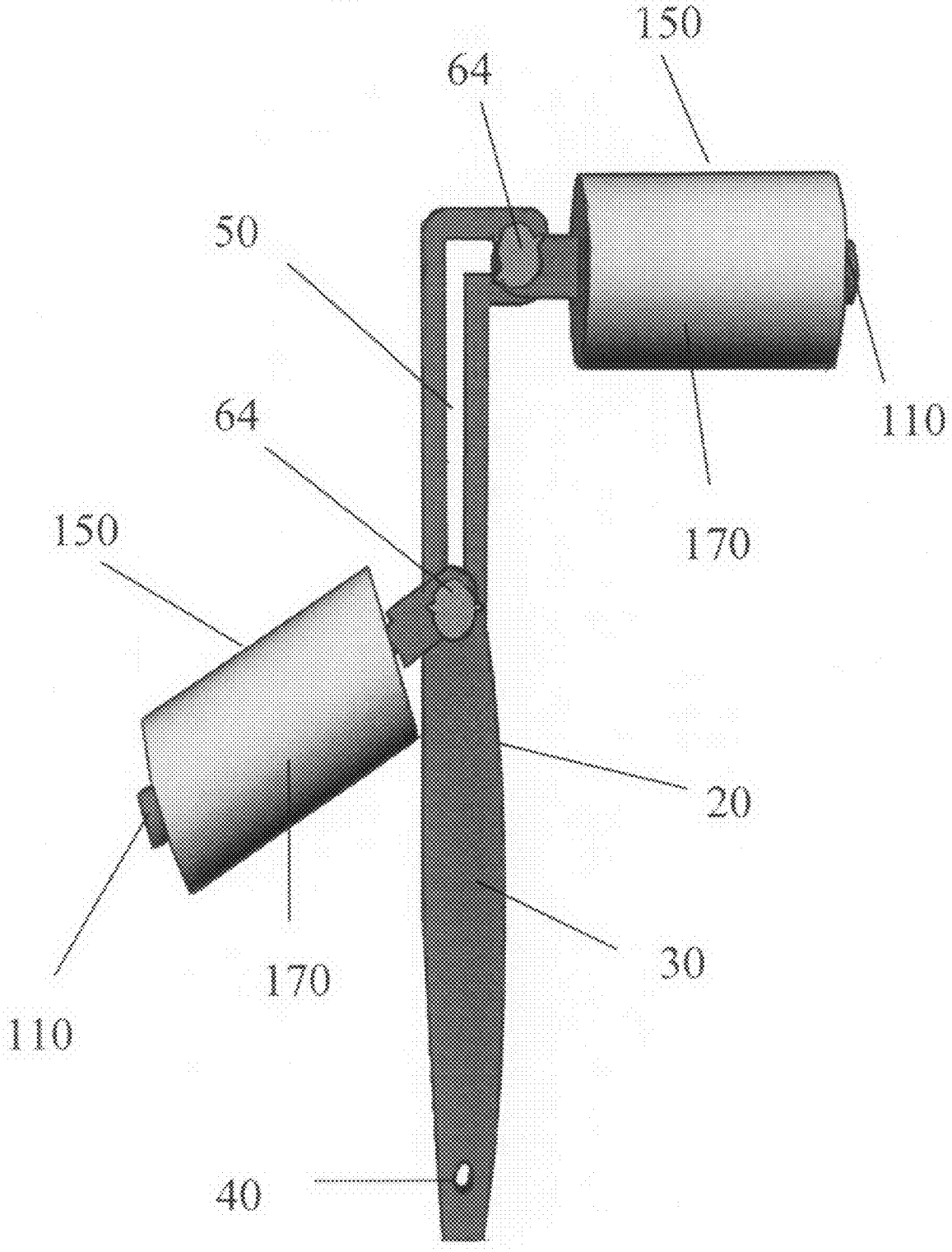

Figure #3
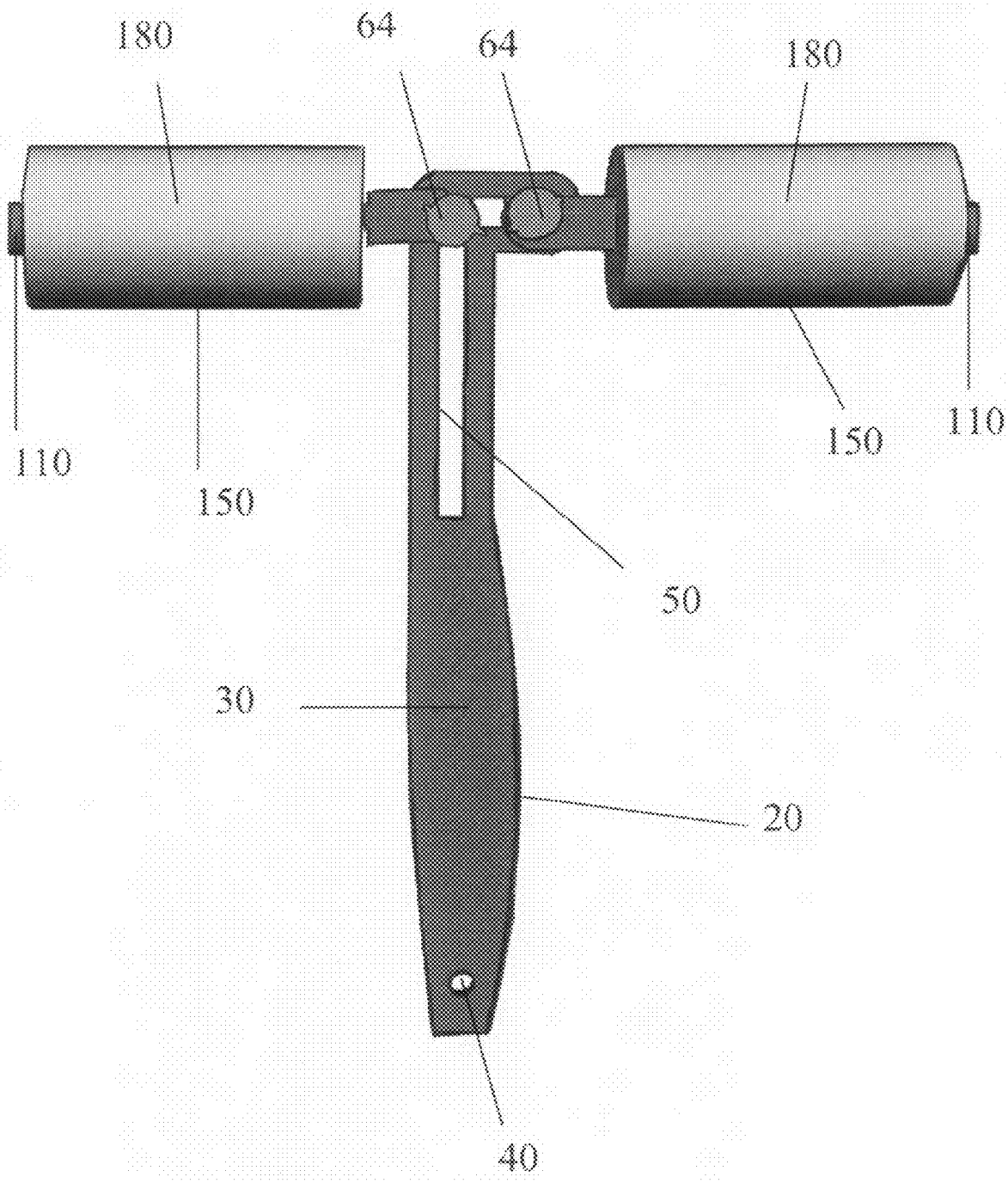

Figure #4
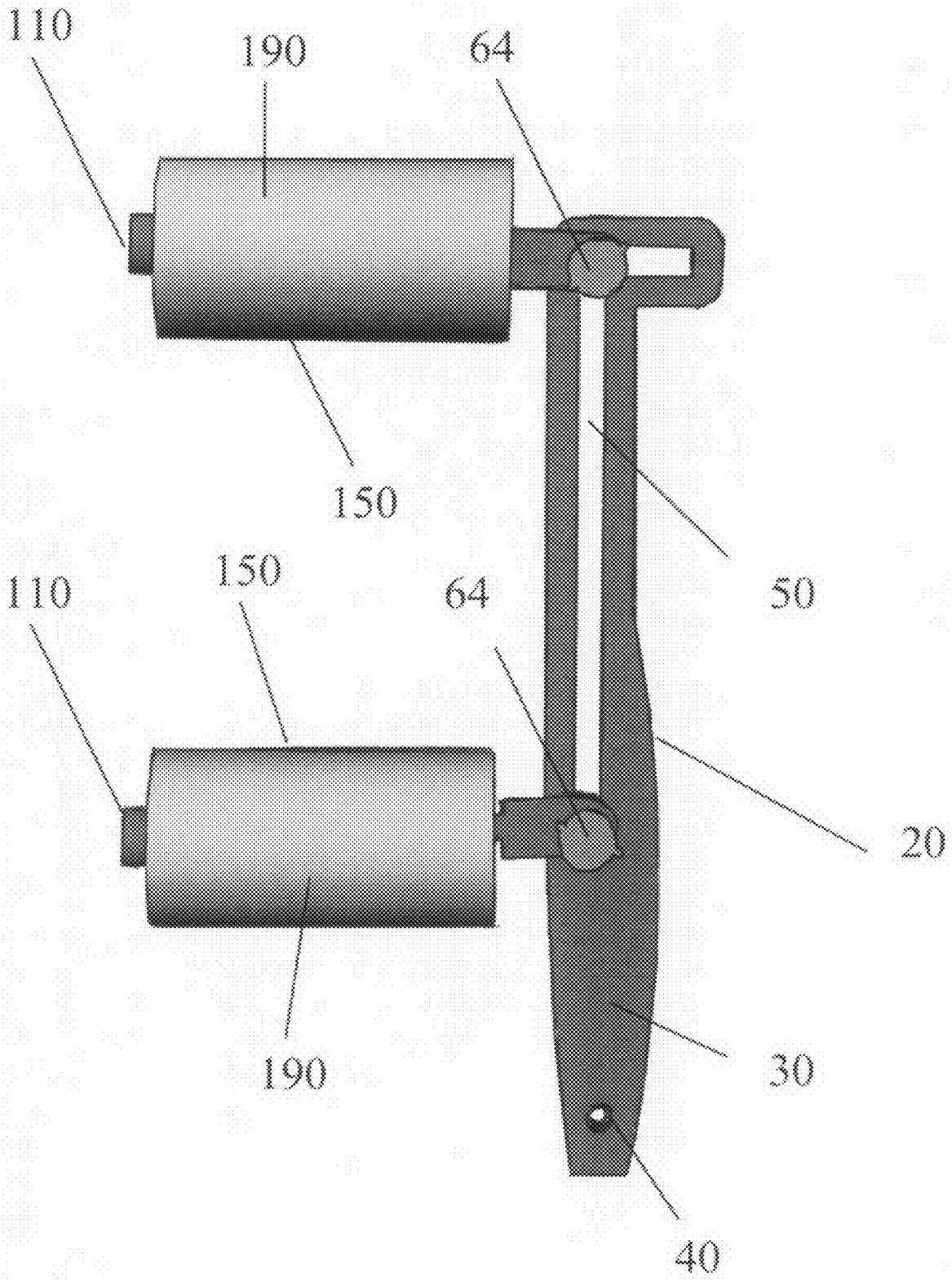

Figure #5
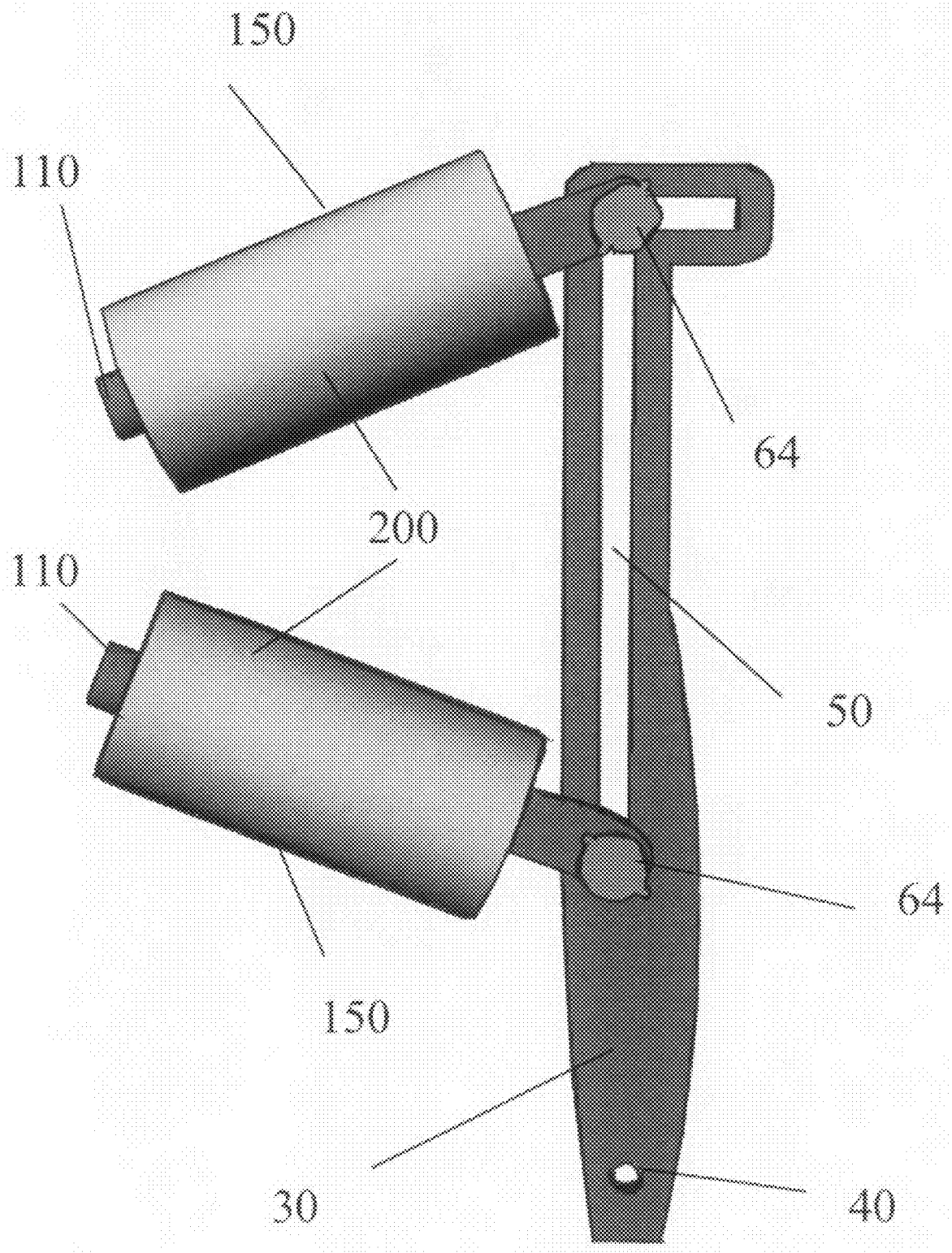

Figure #6
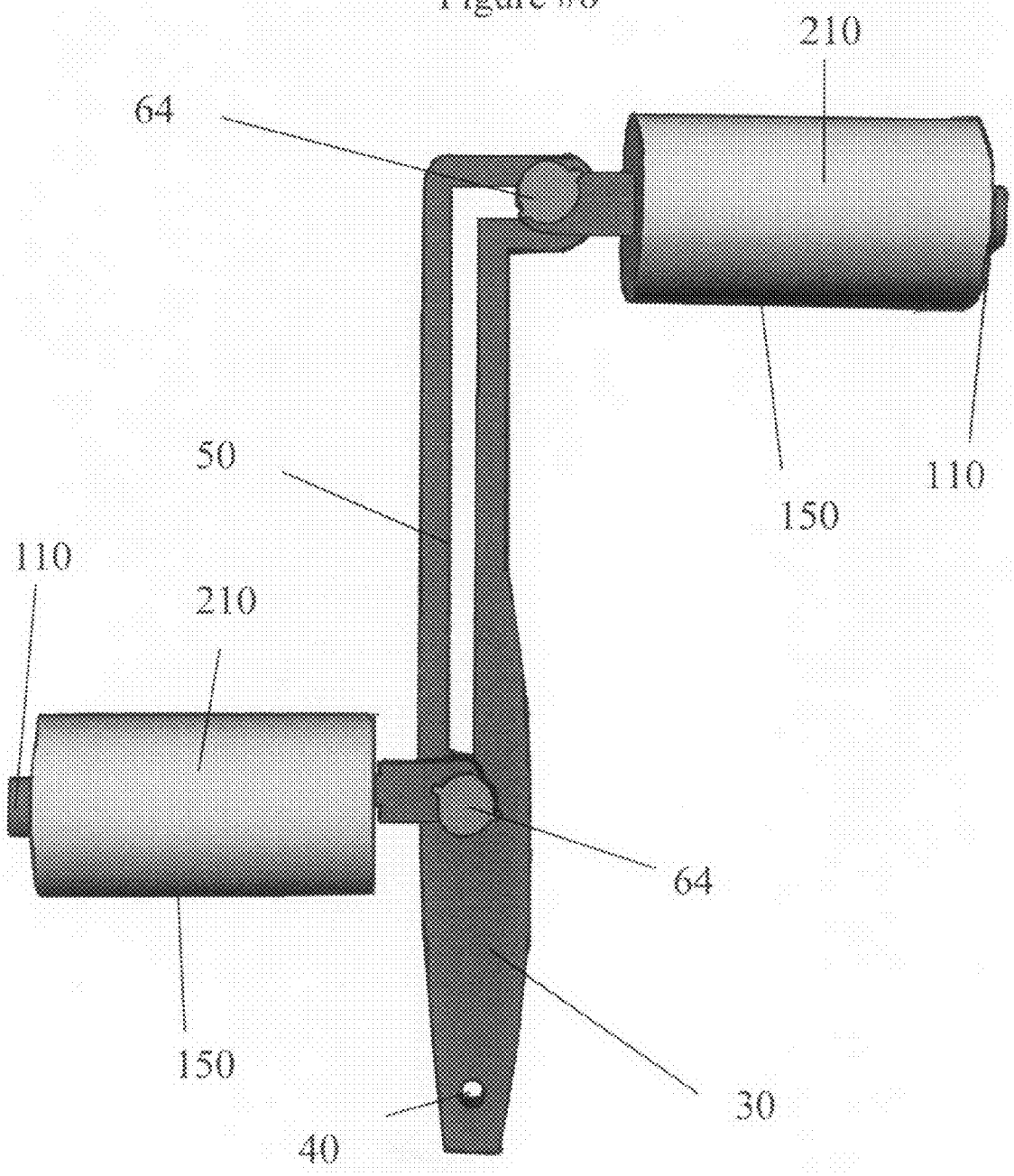

Figure #7
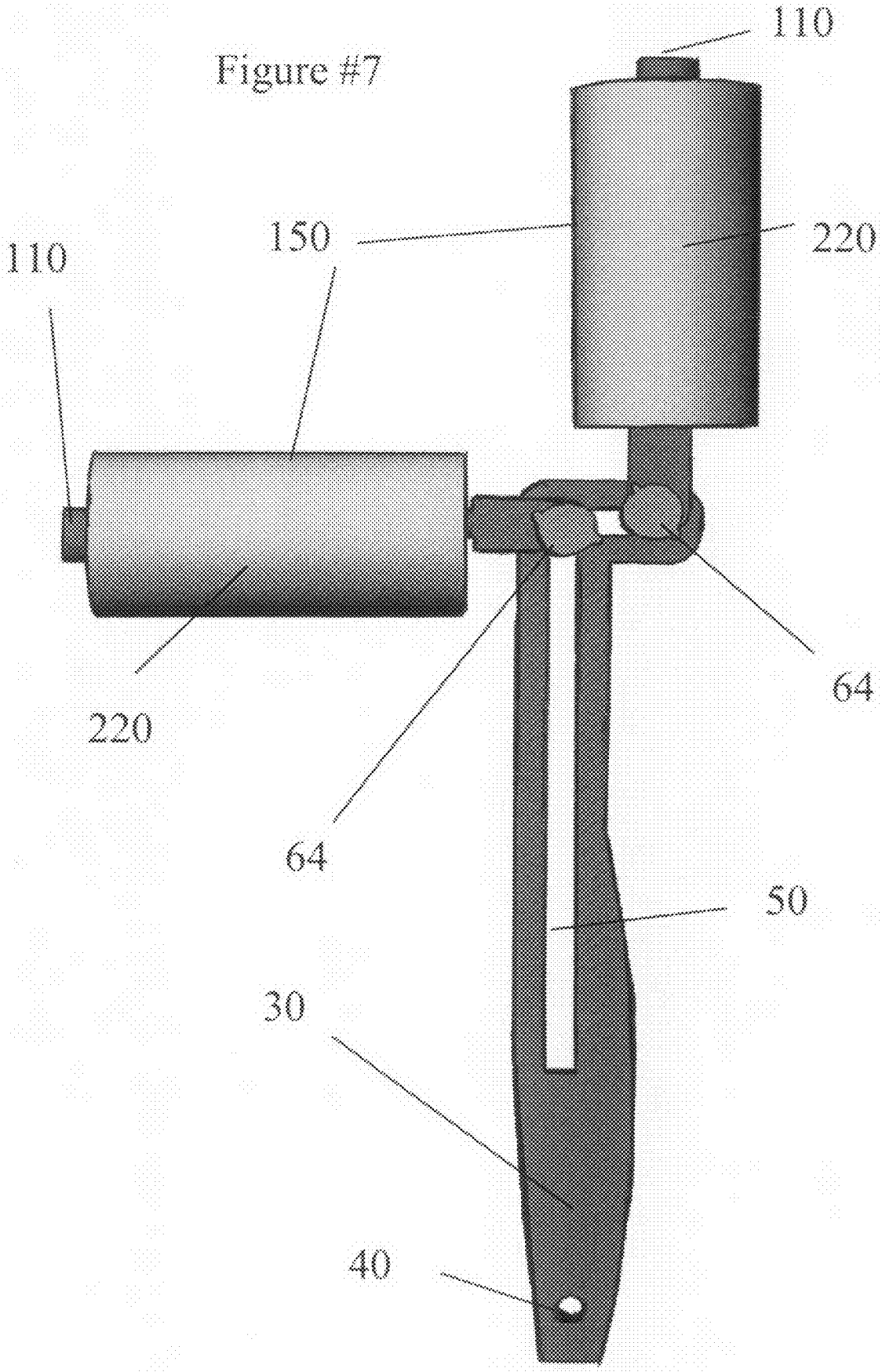

Figure #8
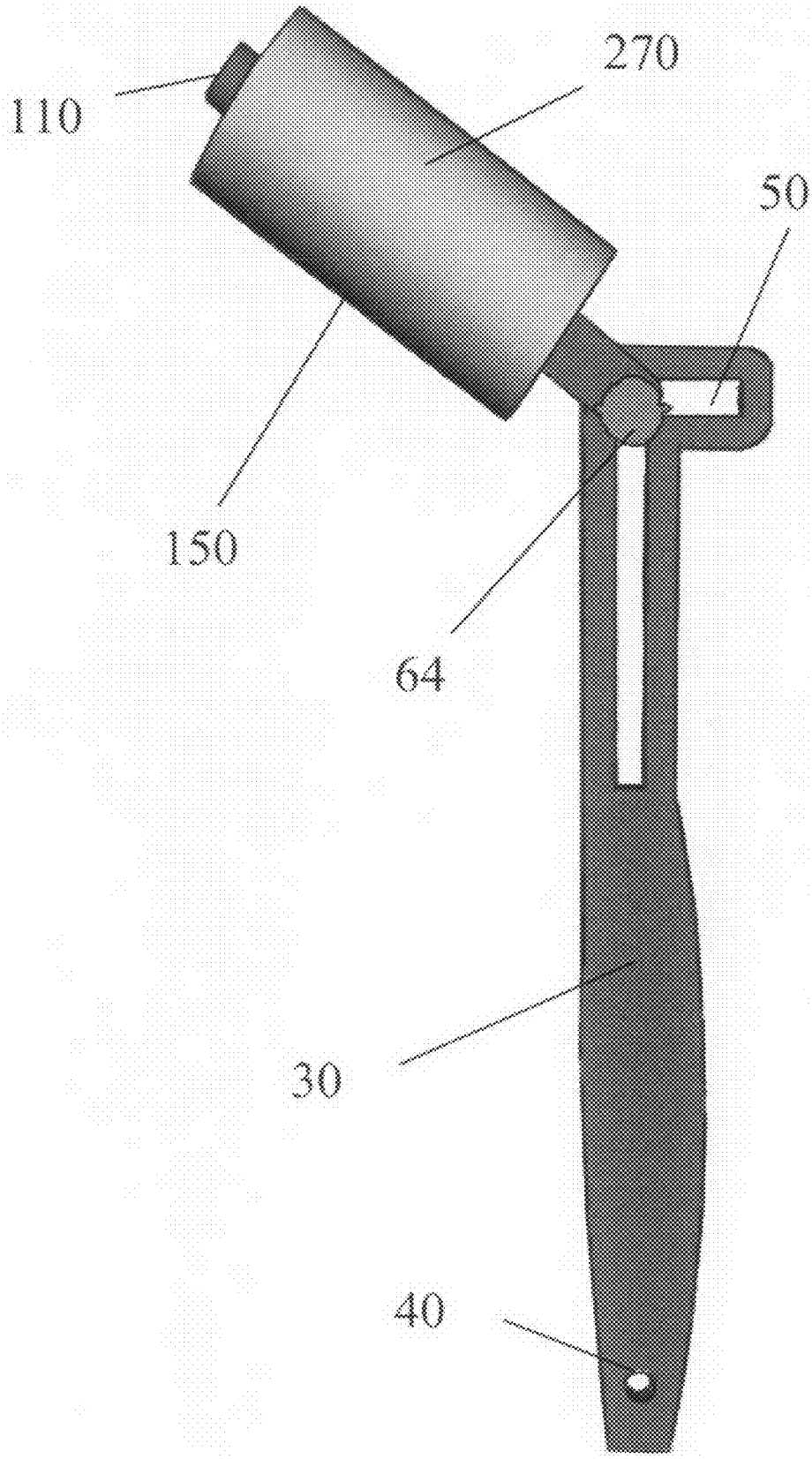

Figure #9
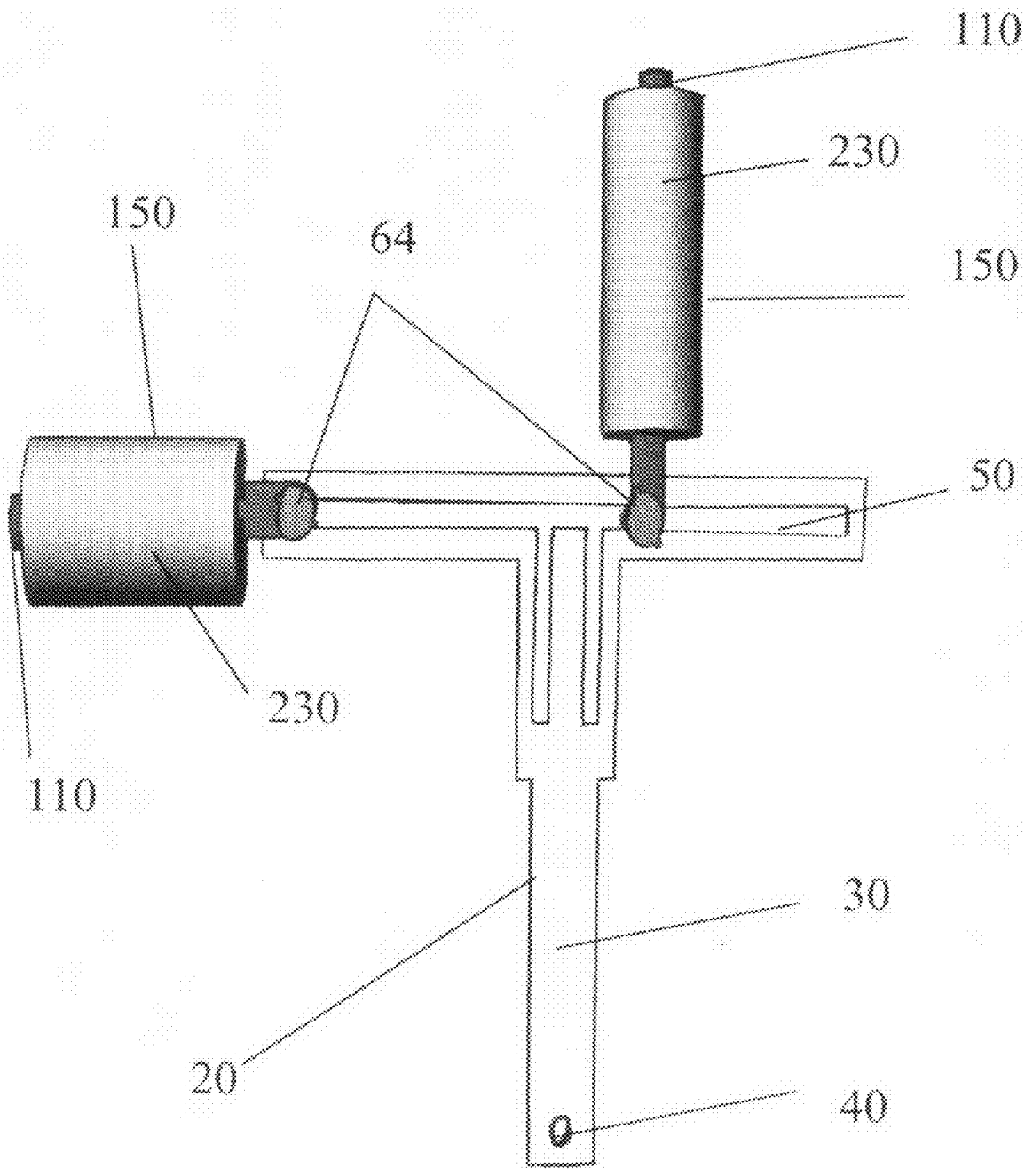

Figure #10
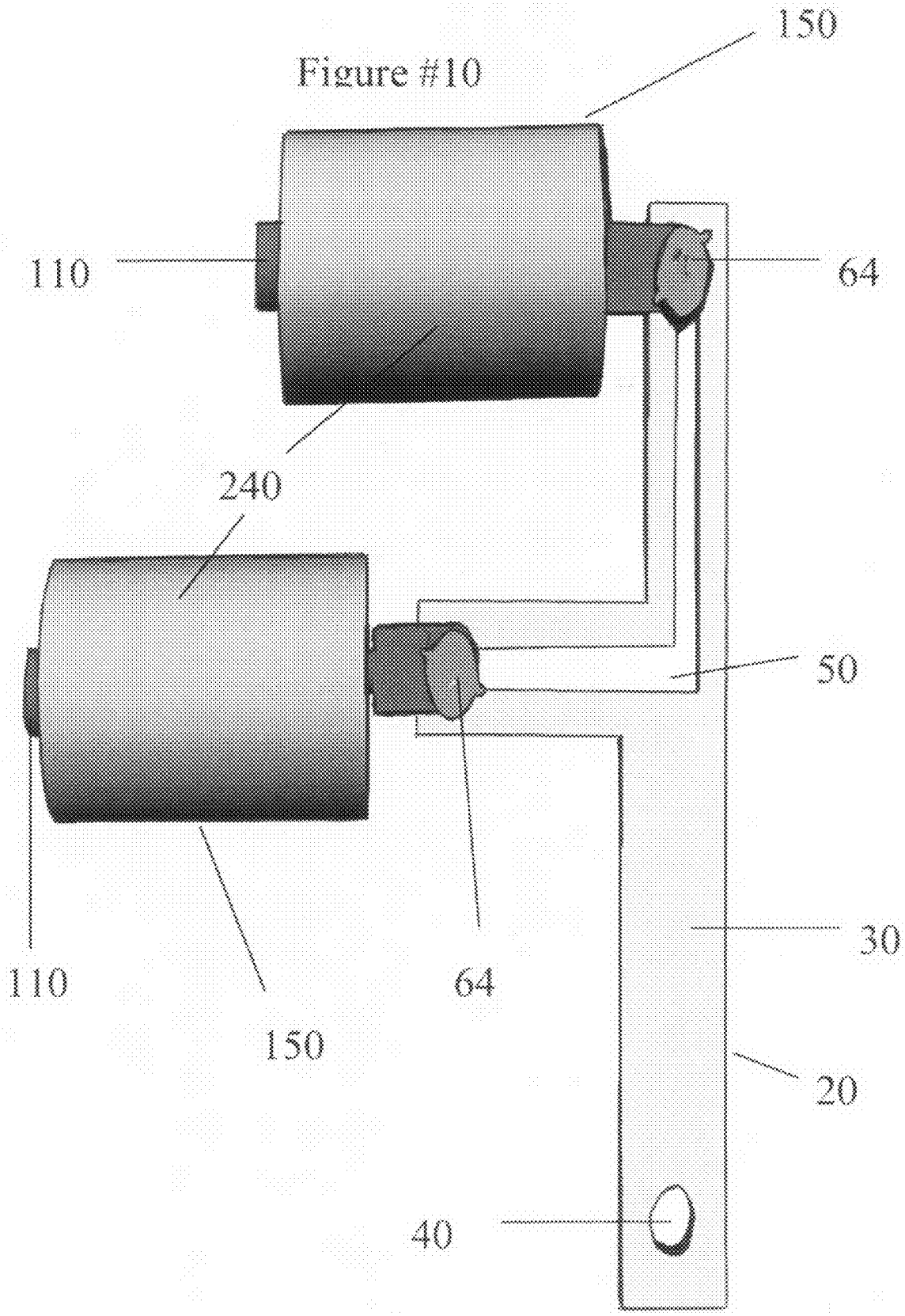

Figure #11
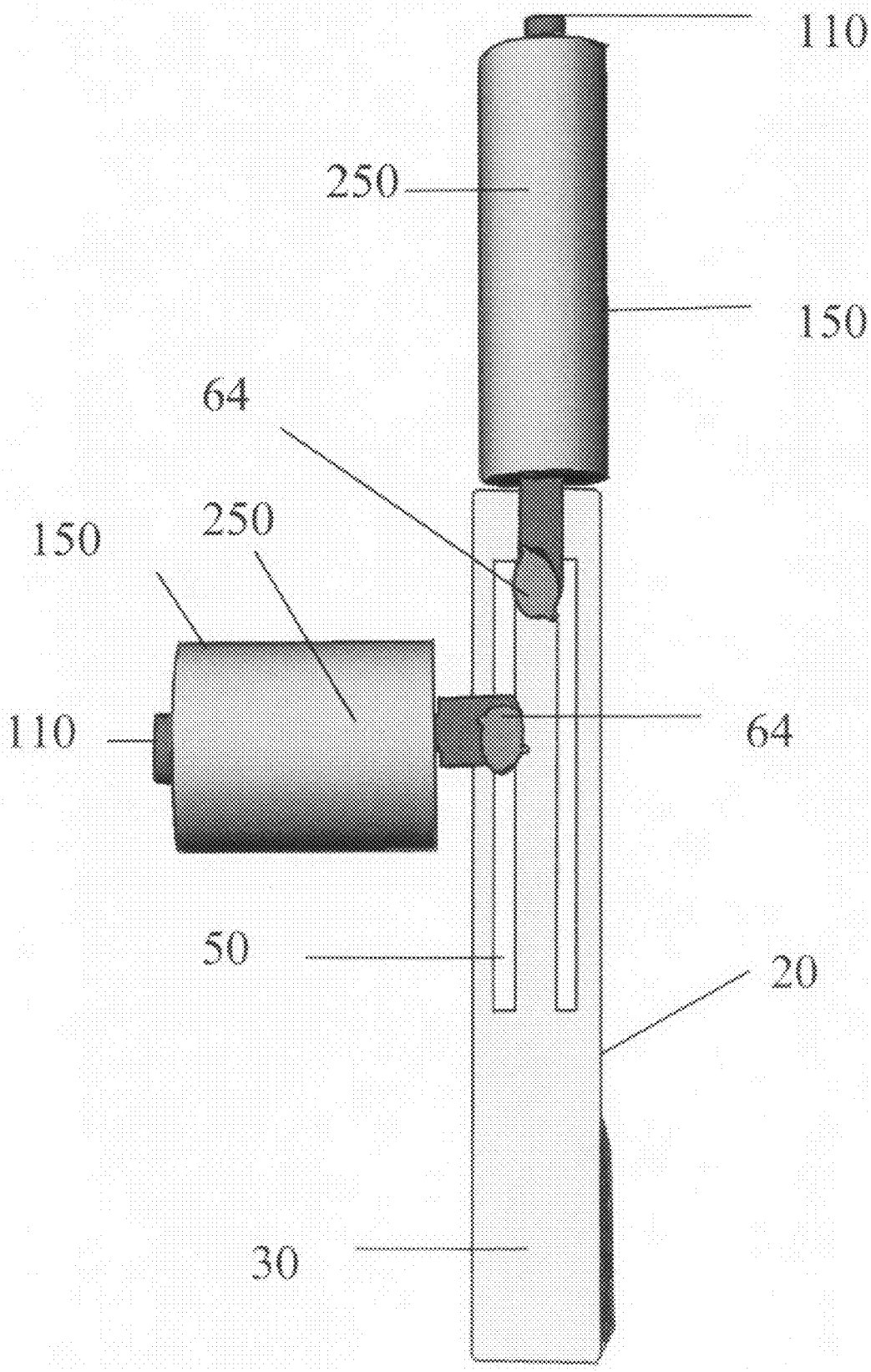

Figure #12
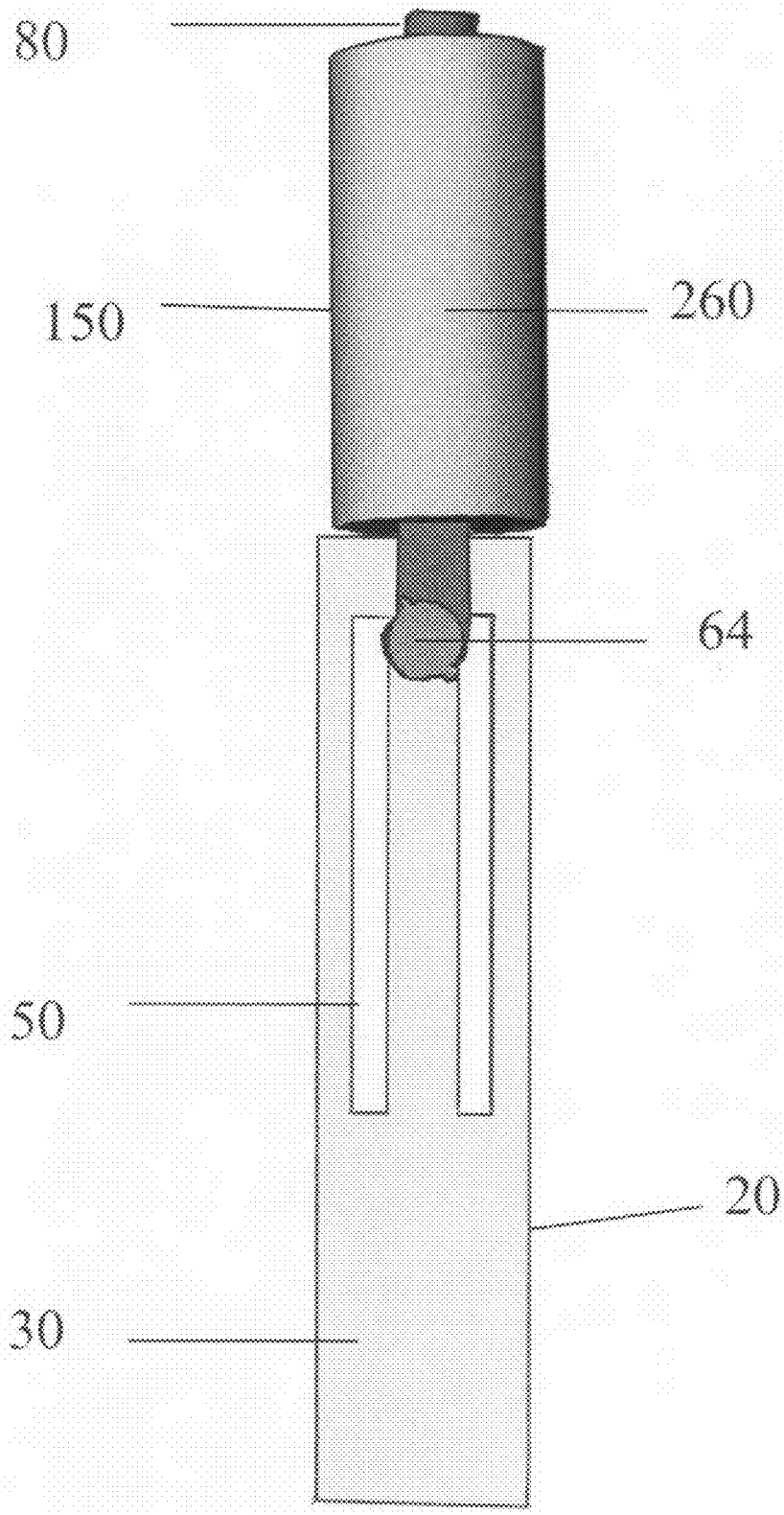

Figure #13
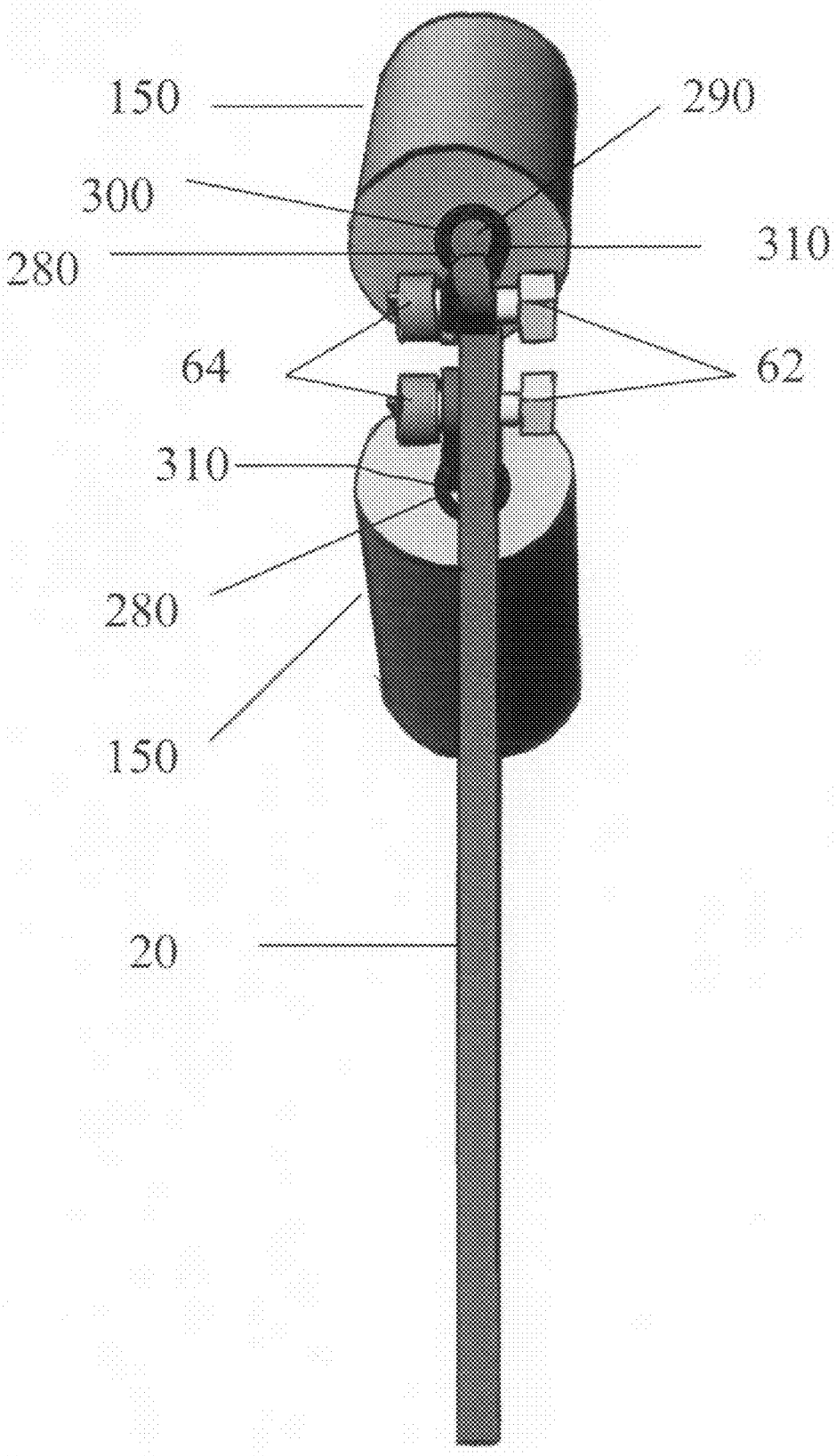

Figure #14
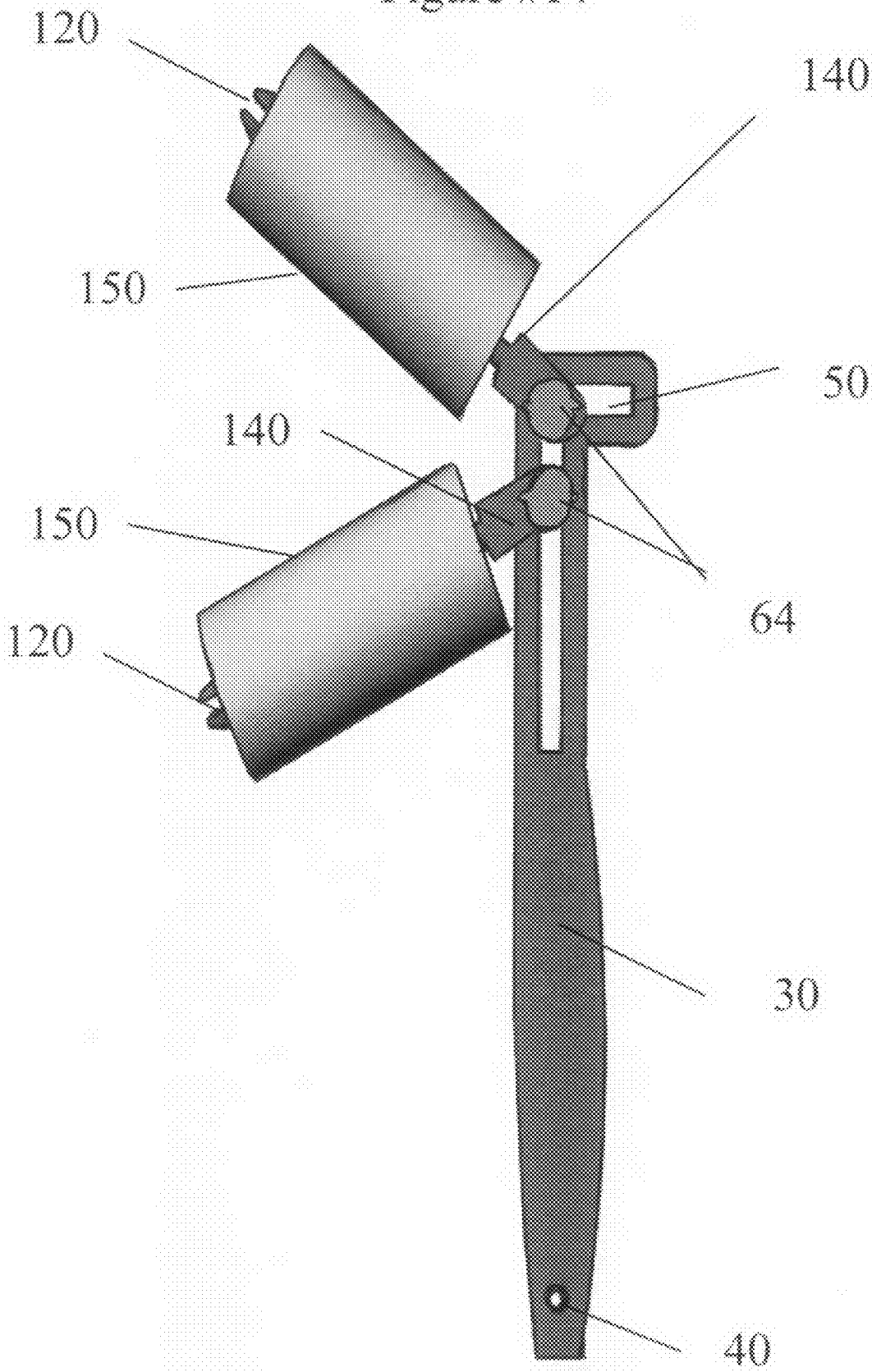

Figure #15
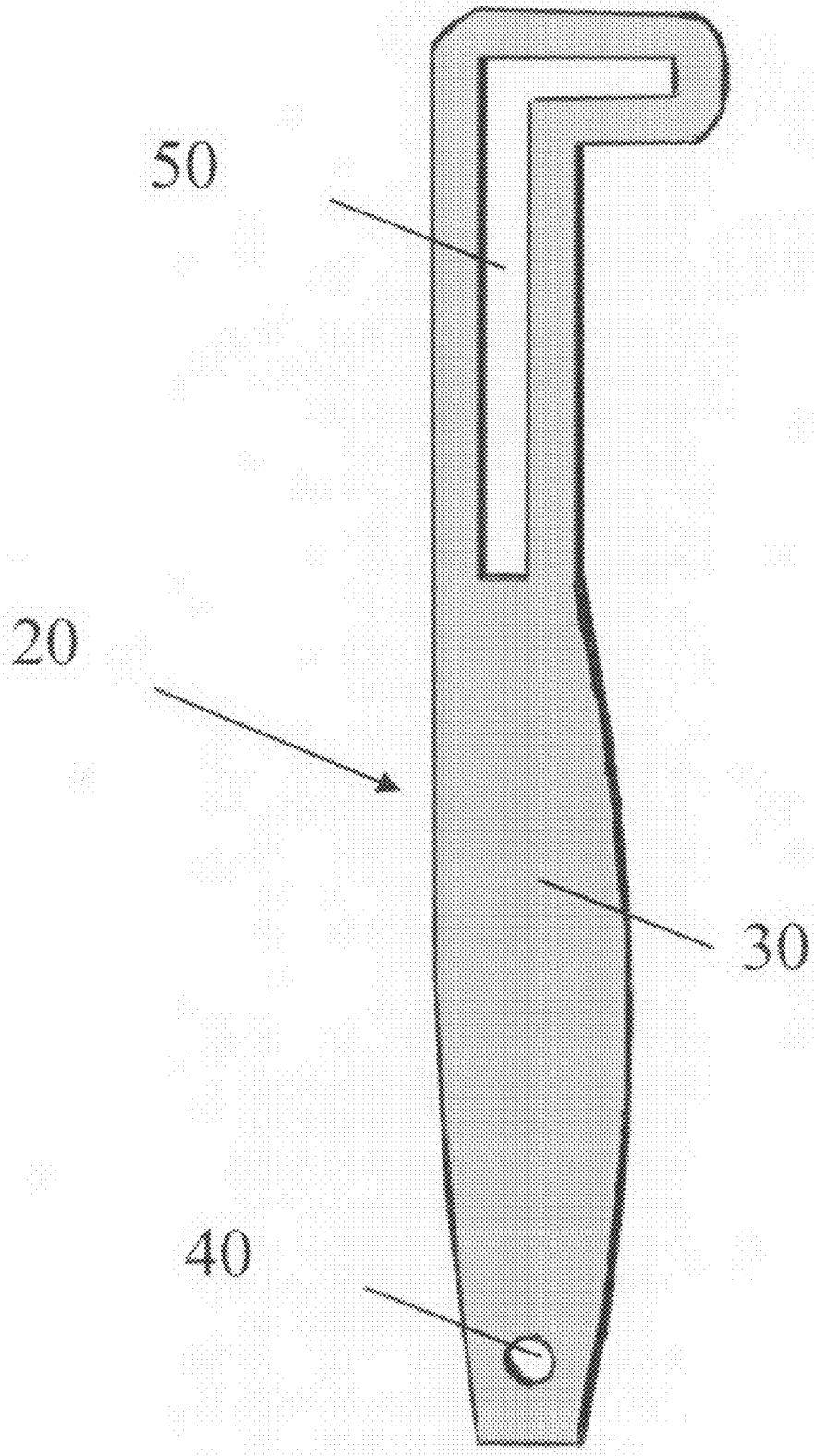

Figure #16
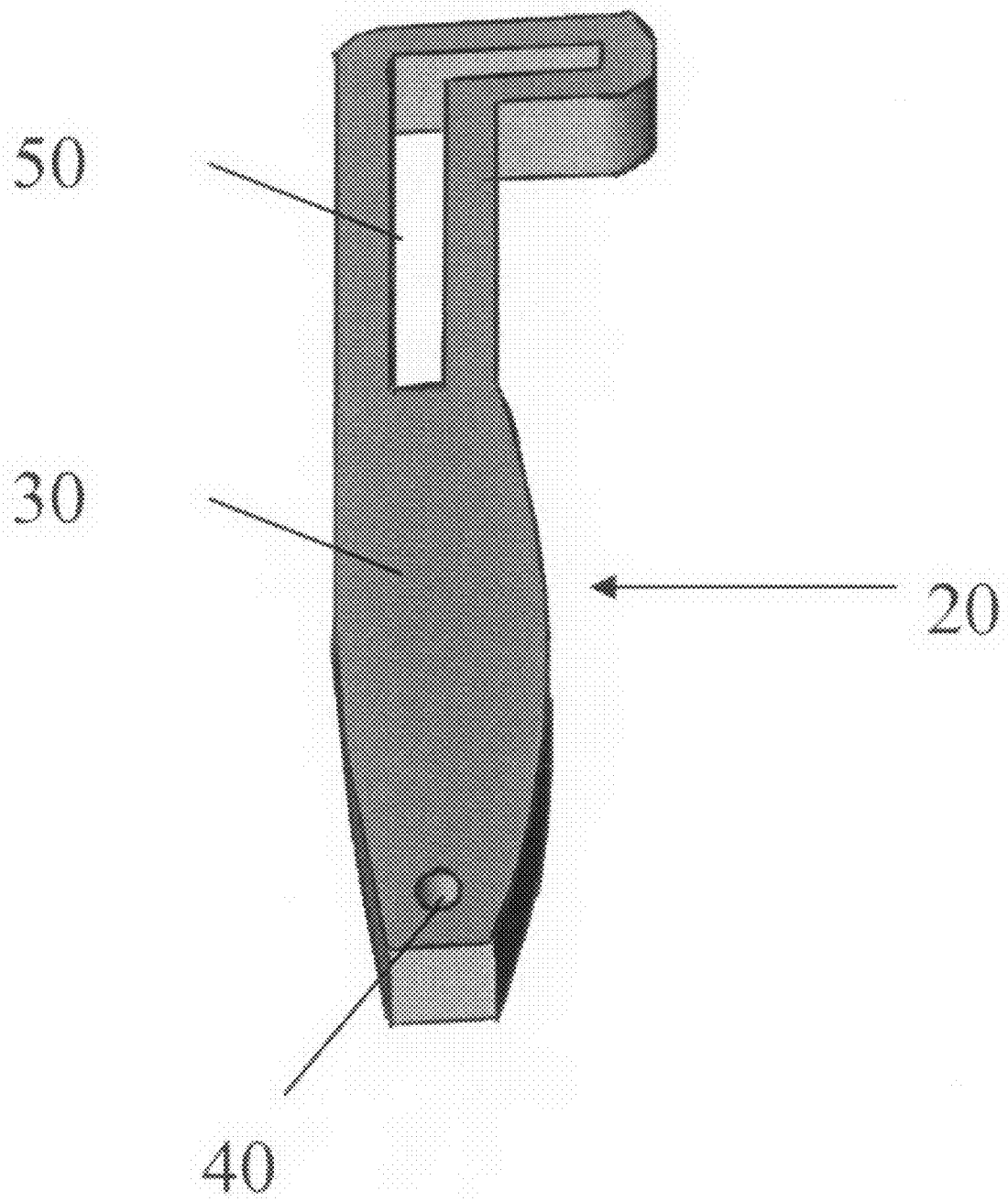

Figure #17
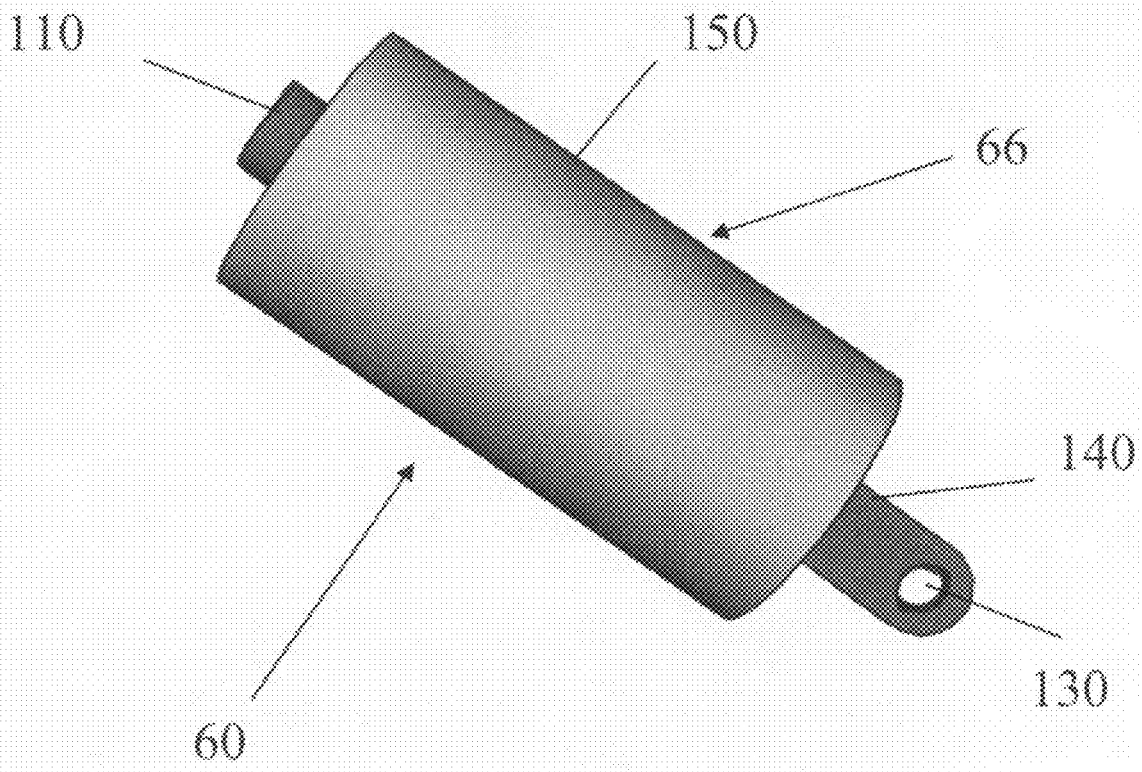

Figure #18
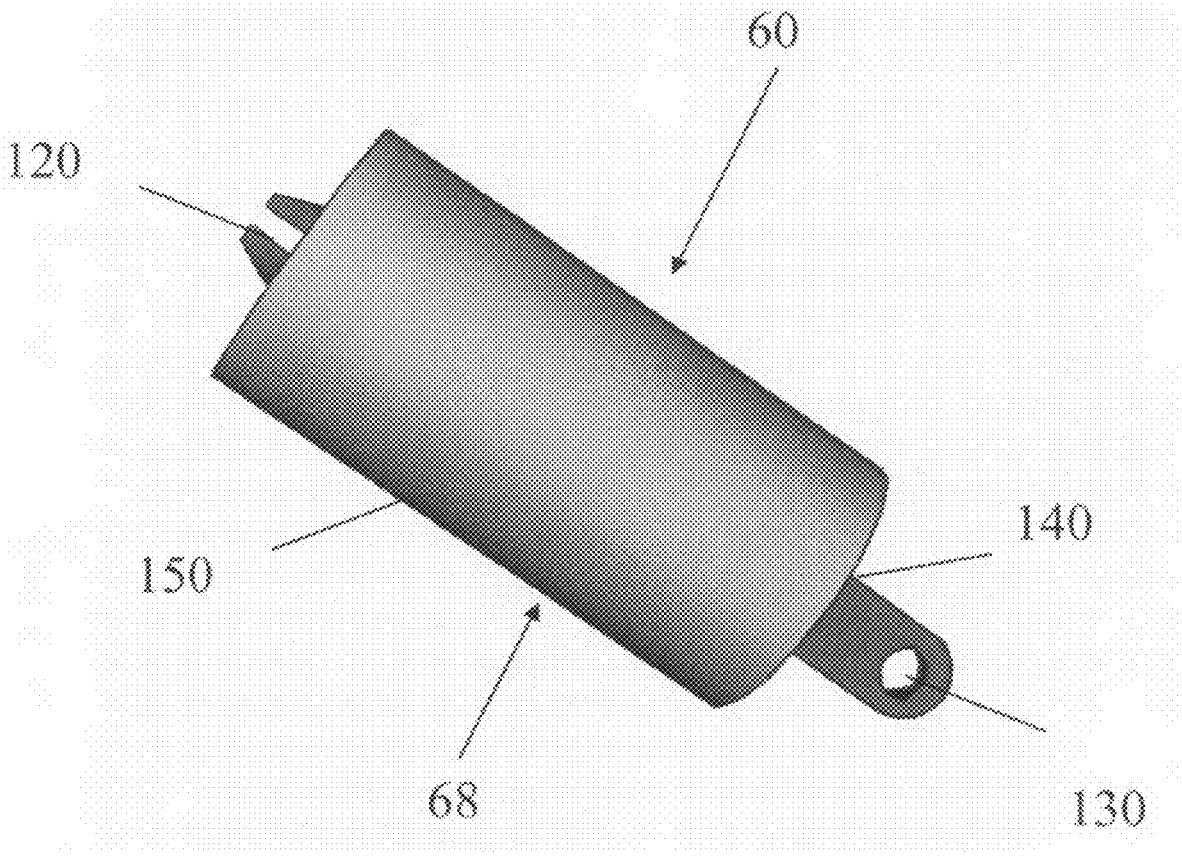

Figure #19
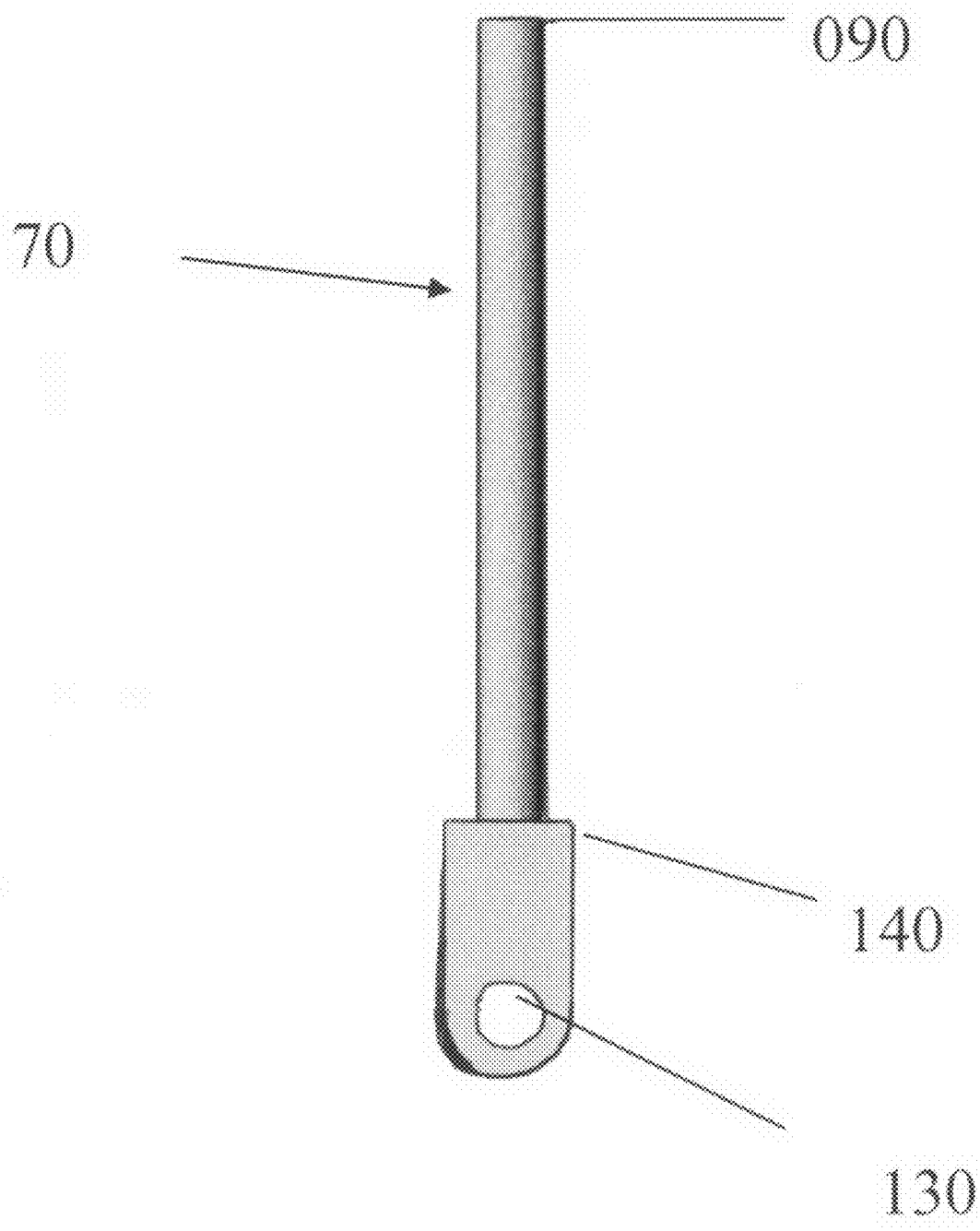

Figure #20
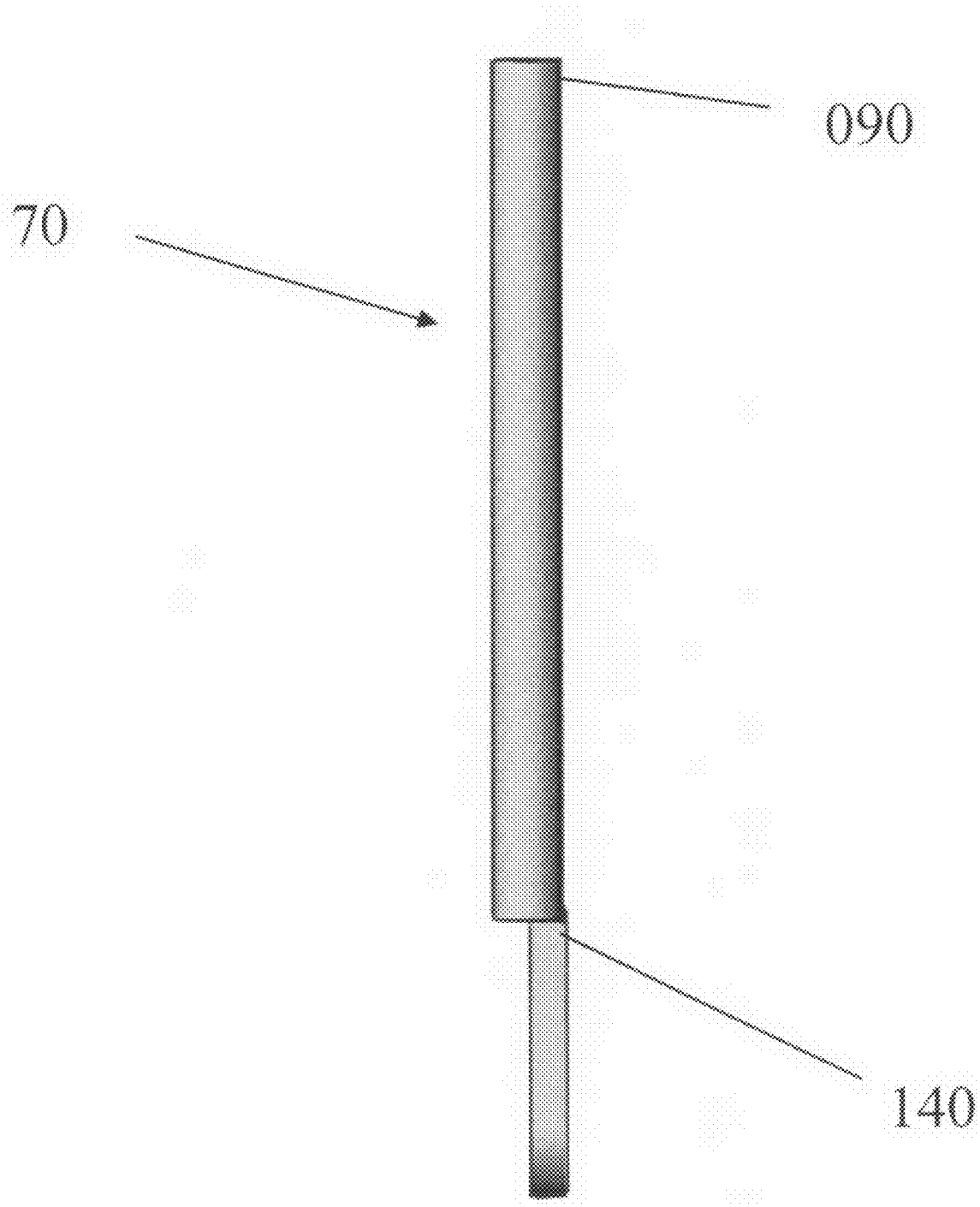

Figure #21
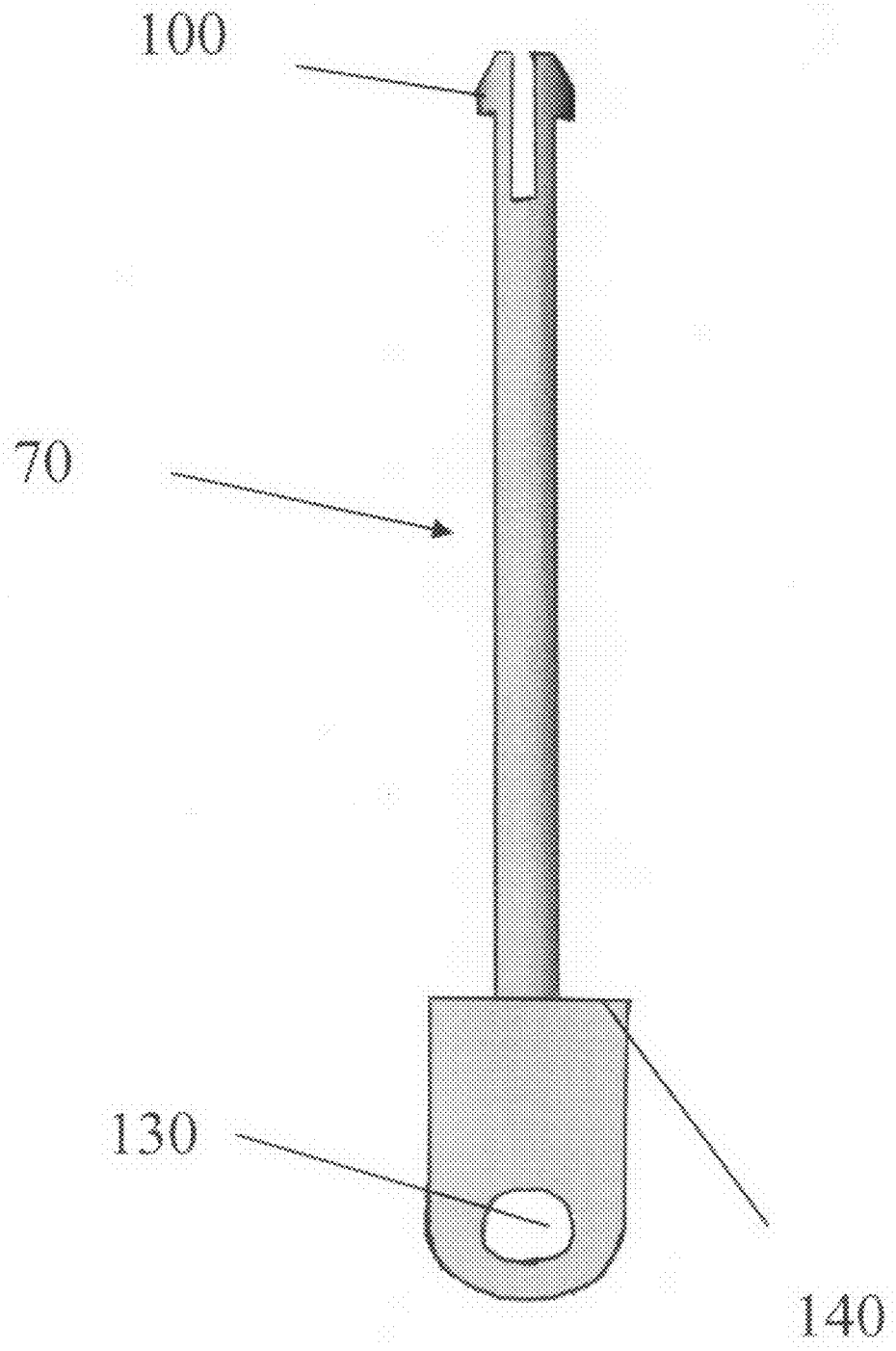

MULTIPLE SHAPE CHANGING ROLLER UNIT

CROSS-REFERENCE TO RELATED APPLICATIONS

Not applicable

BACKGROUND

1. Field of Invention

This invention relates to "roller units" that are used to paint, stain, dust, polish, strip, sand, clean, wipe off & apply chemicals (liquid and powder) to the surface area of multisided objects comprising of bars, posts, poles, shafts, spindles, railings, supports, and columns.

2. Description of Prior Art

The popular method of painting, staining, dusting, polishing, striping, cleaning, wiping off & applying chemicals to the surface area of multisided objects is to use a standard brush that has a handle at one end and brush material pointing 180 degrees straight out of the opposite end of handle or using a standard roller that has a handle located 90 degree to the roller. With this current method one is restricted to starting at zero degrees and brushing or rolling up, down, and around multisided objects until 360 degrees is reached. This method is expensive and time consuming because it demands many strokes of the brush around the surface area of a multisided object and the operator must move around the multisided object in order to act on the entire surface area of said object. The applied coating is less uniform when using brushes and also displays brush marks.

Another method is to use of rollers to apply said coatings to multisided objects. Roller coating is quick, eliminates brush marks, and provides a more uniform coating. Most single rollers are designed for flat surfaces, so they are less adequate when applying coatings to multisided objects.

Prior art multi-roller devices have attempted to provide a solution to one or more problems envisioned hereby include Iuliano et al (U.S. Pat. No. 5,035,022) which discloses three coactive rollers mounted on two fixed and one detachable and adjustable support axle. The paint applicator is expensive, has a complex adjustment process that is time consuming and does not allow for roller contact all around multisided objects while the operator remains on one side object.

Mclendon (U.S. Pat. No. 2,813,292) discloses two side rollers and a central roller operatively interposed there between for mainly painting cylindrical pipe. This paint applicator also requires adjustment, is expensive and does not allow for roller contact all around multisided objects while the operator remains on one side of said object.

Rivadeneira (U.S. Pat. No. 6,957,470 B2) discloses four replaceable rollers pivotally attached to a handle that provides for painting of the two adjoining surfaces forming a typical 90 degree interior corner. This paint applicator is use for interior corners and thus is not suitable for coating the exterior of multisided objects. This paint applicator also requires adjustment, is expensive and does not allow for roller contact all around multisided objects while the operator remains on one side of said object Kierce (U.S. Pat. No. 4,644,604) discloses two rollers disposed in spaced parallel relationship to each other on a flexible frame which the operator must apply compression pressure to bring the rollers in contact with opposite sides of the object being painted. This device leads to operator fatigue during extended operation, does not have the right roller angle to surround multiple railings, like on a porch and is expensive.

Parr (U.S. Pat. No. 3,358,312) discloses a four roller post painter where the rollers are mounted on a frame in a manner to completely encircle the object being painted. Parr's device must be disassembled each time the paint supply on the rollers need replenishing and is restricted to use on square and rectangular shaped post. The post must not be enclosed on both ends or Parr's paint applicator must be disassembled and reassembled around the post. This applicator is expensive and require adjustments.

Bedford (U.S. Pat. No. 2,824,328) discloses two adjustable rollers at angles with a handle. Bedford's device doesn't allow for a plurality of roller positions around the length of the handle. The rollers and handle are all connected at the same spot restricting the rollers to be attached at one and only one spot on handle. This will only allow the rollers to form a V-shape angle sharing the same vortex and not have the freedom to be attached at a plurality of positions around the handle and have the rollers form multiple shapes like my invention.

Accordingly, in spite of the various efforts of the prior art, a need still exists for an improved device that is used to paint, stain, dust, polish, strip, sand, clean, wipe off & apply chemicals (liquid and powder) to the surface area of multisided objects comprising of bars, posts, poles, shafts, spindles, railings, supports, and columns in a manner that is easy & quick to use, low cost, disposable and where the rollers can surround multisided object as the operator stands on only one side of the object eliminating the need to waste time moving around the object to fully coat or impact the surface perimeter of the object allowing for one or multiple rollers to be attached to the handle and be positioned in the same plane as the handle while having the freedom to be adjusted to many shapes and to be placed at several locations around the handle via a slotted pattern groove situated around the handle perimeter.

SUMMARY

In accordance with the present invention, the "multiple shape changing roller unit" mainly comprises a slotted patterned frame handle, two adjustable roller cover & rod assemblies which are mounted onto said slotted frame handle.

The present invention allows the operator to just stand on one side of multisided objects while surrounding the object with the invention thus reducing the amount of time to cover the entire surface area of multisided objects, due to not having to walk around to the opposite side of the said object to surround the surface of the object with my invention. My invention reduces the amount of time to paint, stain, dust, polish, strip, sand, clean, wipe off & apply chemicals (liquid and powder) to the surface area of multisided objects comprising of bars, posts, poles, shafts, spindles, railings, supports, and columns. My invention is very quick and simple to manufacture making it much cheaper than other devices. The two adjustable roller cover & rod assemblies can be adjusted to provide many angles and positions and shapes to better surround and act on various multisided objects. The roller covers on my invention can be covered with any suitable material designed to provide effective painting, staining, dusting, polishing, stripping, sanding, cleaning, wiping off & applying of liquid and power chemicals.

OBJECTS AND ADVANTAGES

Accordingly, several objects and advantages of the "multiple shape changing roller unit" described in my above patent are:

(a) to provide a way to concurrently paint, stain, dust, polish, strip, sand, clean, wipe off or apply chemicals (liquid and powder) to different sides around the surface area of multisided objects comprising of bars, posts, poles, shafts, spindles, railings, supports, and columns but not limiting to the aforementioned group of objects;

(b) to provide a faster way to paint, stain, dust, polish, strip, sand, clean, wipe off or apply chemicals (liquid and powder) to multisided objects comprising bars, posts, poles, shafts, spindles, railings, supports, and columns but not limiting to the aforementioned group of objects;

(c) to provide a more efficient way of painting, staining, dusting, polishing, striping, sanding, cleaning, wiping off or applying chemicals (liquid and powder) to multisided objects comprising bars, posts, poles, shafts, spindles, railings, supports, and columns but not limiting to the aforementioned group of objects;

(d) to provide a cheaper way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(e) to provide an easier way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(f) to provide a simple way paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(g) to provide a reduction in the number of people require to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(h) to provide a better way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

Further objectives and advantages of my invention will become apparent from a consideration of the drawings and ensuing description.

DRAWING FIGURES

In accordance with the present invention the "multiple shape changing roller unit" mainly comprises a slotted patterned frame handle, two adjustable roller cover & rod assemblies which are mounted onto said slotted frame handle.

FIG. 1) shows the "multiple shape changing roller unit" with the permanent roller cover & rod assembly in the preferred position.

FIG. 2) shows the "multiple shape changing roller unit" with the permanent roller cover & rod assembly in position 2.

FIG. 3) shows the "multiple shape changing roller unit" with the permanent roller cover & rod assembly in position 3.

FIG. 4) shows the "multiple shape changing roller unit" with the permanent roller cover & rod assembly in position 4.

FIG. 5) shows the "multiple shape changing roller unit" with the permanent roller cover & rod assembly in position 5.

FIG. 6) shows the "multiple shape changing roller unit" with the permanent roller cover & rod assembly in position 6.

FIG. 7) shows the "multiple shape changing roller unit" with the permanent roller cover & rod assembly in position 7.

FIG. 8) shows the "multiple shape changing roller unit" with only one permanent roller cover & rod assembly attached.

FIG. 9) shows the T-shaped "multiple shape changing roller unit" with the permanent roller cover & rod assembly.

FIG. 10) shows the Angled-shaped "multiple shape changing roller unit" with the permanent roller cover & rod assembly.

FIG. 11) shows the Straight-shaped "multiple shape changing roller unit" with the permanent roller cover & rod assembly.

FIG. 12) shows the Straight-shaped "multiple shape changing roller unit" with only one permanent roller cover & rod assembly attached.

FIG. 13) shows "multiple shape changing roller unit" with the permanent roller cover & rod assembly in a side view.

FIG. 14) shows the "multiple shape changing roller unit" with the quick disconnect roller cover & rod assembly.

FIG. 15) shows the "multiple shape changing roller unit" frame side view.

FIG. 16) shows the "multiple shape changing roller unit" frame top view.

FIG. 17) shows the "multiple shape changing roller unit" permanent roller cover and rod assembly.

FIG. 18) shows the "multiple shape changing roller unit" quick disconnect non permanent roller cover and rod assembly.

FIG. 19) shows the "multiple shape changing roller unit" rod used with the permanent roller cover & rod assembly front view.

FIG. 20) shows the "multiple shape changing roller unit" rod used with the permanent roller cover & rod assembly side view.

FIG. 21) shows the "multiple shape changing roller unit" rod used with the quick disconnect non permanent roller cover & rod assembly.

REFERENCE NUMERALS IN DRAWINGS

010 multiple shape changing roller unit
020 slotted patterned frame
030 slotted patterned frame handle
040 slotted patterned frame hanging hole
050 slotted patterned frame slot pattern
060 roller cover & rod assembly
062 roller cover & rod assembly connecting bolt
064 roller cover & rod assembly connecting wing nut
066 roller cover & rod permanent assembly
068 roller cover & rod detachably assembly
070 rod
080 rod retainer for roller cover
090 rod with permanent roller cover connection
100 rod with quick disconnect roller cover connection
110 rod permanent retaining end
120 rod non permanent retaining end
130 rod attachment hole
140 rod stop for roller cover

150 roller cover
160 roller cover material
170 roller cover painting material
180 roller cover staining material
190 roller cover sanding material
200 roller cover dusting material
210 roller cover polishing material
220 roller cover liquid chemical applying material
230 roller cover powder chemical applying material
240 roller cover stripping material
250 roller cover cleaning material
260 roller cover print material for identification or labeling
270 roller cover foam material
280 roller cover core
290 roller cover core inside surface
300 roller cover core outside surface
310 roller cover core hole

DESCRIPTION

Preferred Adjustable Multisided Roller Brush

A preferred embodiment of the "multiple shape changing roller unit" is illustrated in FIG. 1. The "multiple shape changing roller unit 010" main parts generally comprise of a slotted patterned frame 020 and a roller cover & rod assembly 060.

The slotted patterned frame 020, includes a slotted patterned frame handle 030, a slotted patterned frame hanging hole 040, and a slotted patterned frame slot pattern 050.

The roller cover & rod assembly 060, includes a rod 70, & a roller cover 150, a roller cover & rod assembly connecting bolt 062, and a roller cover & rod assembly connecting wing nut 064.

The rod 070, includes a rod permanent retaining end 110, a rod attachment hole 130, a rod stop for roller cover 140

The roller cover 150, includes a roller cover material 160, a roller cover core 280, a roller cover core inside surface 290, a roller cover core outside surface 300, and a roller cover core hole 310

The roller cover 150, is permanently attached to the rod 070. The roller cover and rod assembly 060 is detachably mounted to the slotted patterned frame 020.

The roller cover 150, with the desired roller material 120, is chosen for the specific coating applications.

The slotted patterned frame 020, can be manufactured in a plurality of ways comprising molded, machined, laser cut, water cut, plasma cut, wire EDM cut, die cut and stamped. The preferred method is injection molding due to the low cost for high volume. For low volume production machined, laser cut, water cut, plasma cut, wire EDM cut, die cut and stamped frames will be built. There are a plurality of materials the slotted patterned frame 020, can be made from comprising plastic, metal, and wood. The preferred material is plastic in high volume applications.

Advantages

From the description above, a number of advantages of the "multiple shape changing roller unit" become evident:

(a) provides a way to concurrently paint, stain, dust, polish, strip, sand, clean, wipe off or apply chemicals (liquid and powder) to different sides around the surface area of multisided objects comprising of bars, posts, poles, shafts, spindles, railings, supports, and columns but not limiting to the aforementioned group of objects;

(b) provides a faster way to paint, stain, dust, polish, strip, sand, clean, wipe off or apply chemicals (liquid and powder) to multisided objects comprising bars, posts, poles, shafts, spindles, railings, supports, and columns but not limiting to the aforementioned group of objects;

(c) provides a more efficient way of painting, staining, dusting, polishing, striping, sanding, cleaning, wiping off or applying chemicals (liquid and powder) to multisided objects comprising bars, posts, poles, shafts, spindles, railings, supports, and columns but not limiting to the aforementioned group of objects;

(d) provides a cheaper way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(e) provides an easier way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(f) provides a simple way paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(g) provides a reduction in the number of people require to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(h) provides a better way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

Operation (Adjustable Multisided Roller Brush)

The first step would be to determine what application the "multiple shape changing roller unit" is going to be used in. This would determine which roller material you needed. If you were painting, staining, dusting, polishing, striping, cleaning, wiping off & applying chemicals (liquid and powder), drying, sanding, or scraping each of theses different operations would require you to pick out a different roller material for that specific operation. Once you have decided what roller material you need for the specific job, such as needing a painting roller material for painting porch railing, you would then be ready to start using the "multiple shape changing roller unit".

An operator would adjust both roller cover and rod assemblies to the proper shape for the specific object the roller cover will act upon. The bolt & wing nut for the roller cover & rod assembly will then be tightened to the desired position.

An operator would then put the slotted patterned frame handle of the "multiple shape changing roller unit" in the palm of his hand and wrap his fingers around the handle. While holding the "multiple shape changing roller unit", dip the roller covers into the paint, stain, polish, stripping compound, or other chemicals (liquid and powder). Use a special pan to wipe off excess coating from the roller covers, before application, to ensure uniform coating is left on the roller covers without coating dripping from the roller covers. If it is a dusting, sanding or wiping operation where no coating will be applied to a multisided object then there will be no need to dip the roller covers into a substance or coating.

Place the roller covers around the multisided object. After the roller cover opening is around the multisided object, proceed to move along the right surface area length of the multisided object to ensure that the rollers are applied around a 180 degree section of the entire surface area length of the right side of the multisided object.

As you use the handle to apply pressure against the multisided object with the roller covers, the roller covers will rotate as you move up and down along the surface area length of the multisided object. Then while standing on the same side of the multisided object, flip the multi-head opening so that the opening facing the opposite direction. Then proceed to roll along the left surface area length of the multisided object to ensure that the coating is being applied to the other 180-degree section of the surface area length of the left side of the multisided object.

The roller covers should form a loop around the multisided object allowing you to apply liquid or powder to part or all of the surface area of the of the multisided object. Sometimes it may be necessary to flip the "multiple shape changing roller unit" over causing the roller covers to face the opposite direction so that the other sections of the multisided object can also be acted upon by the roller covers. This application can be repeated until the entire surface area of the multisided object, 360 degrees around, is covered by the roller covers ensuring that the liquids or powder on the roller covers is applied to the multisided object's complete surface or if no chemicals are used the roll material has acted on the entire surface of the multisided object. This can all be done from standing on one side of the multisided object.

In the dusting, drying, sanding and surface stripping applications the same process as above is repeated except there is no liquid or power being applied to the multisided object. The roller material of the roller cover is only being applied to the surface area of the multisided object and these different roller materials act on the object to dust, dry, sand and strip the surface area of the multisided object. This process is repeated until the entire surface area of the multisided object, 360 degrees around the entire surface area of the object is dusted, dried, sanded, or stripped.

CONCLUSIONS, RAMIFICATIONS, AND SCOPE

Accordingly, the reader will see that the "multiple shape changing roller unit" of this invention has advantages in that (a) it provides a way to concurrently paint, stain, dust, polish, strip, sand, clean, wipe off or apply chemicals (liquid and powder) to different sides around the surface area of multisided objects comprising of bars, posts, poles, shafts, spindles, railings, supports, and columns but not limiting to the aforementioned group of objects;

(b) it provides a faster way to paint, stain, dust, polish, strip, sand, clean, wipe off or apply chemicals (liquid and powder) to multisided objects comprising bars, posts, poles, shafts, spindles, railings, supports, and columns but not limiting to the aforementioned group of objects;

(c) it provides a more efficient way of painting, staining, dusting, polishing, striping, sanding, cleaning, wiping off or applying chemicals (liquid and powder) to multisided objects comprising bars, posts, poles, shafts, spindles, railings, supports, and columns but not limiting to the aforementioned group of objects;

(d) it provides a cheaper way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(e) it provides an easier way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(f) it provides a simple way paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(g) it provides a reduction in the number of people require to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

(h) it provides a better way to paint, stain, dust, polish, strip, sand, clean, wipe off & apply chemicals (liquid and powder) to multisided objects comprising bars, posts, poles, shafts, spindles, railings, supports, and columns but not limiting to the aforementioned group of objects;

Further objectives and advantages of my invention will become apparent from a consideration of the drawings and ensuing description. Although the description above contains much specificity, these should not be construed as limiting the scope of the invention but as merely providing illustrations of some of the presently preferred embodiments of the invention.

Thus the scope of the invention should be determined by the appended claims and their legal equivalents, rather than just by the examples given.

I claim:

1. An adjustable roller assembly comprising:

an elongate frame member defining a handle at a first end thereof, said frame member further including means defining a slot in a second end thereof, the slot including a first portion extending along the length of the frame member and a second portion extending transverse to the length of the frame member and the first portion;

a first roller assembly comprising an elongate rod rotatably supporting a roller cover thereon, an end of the rod including means to adjustably couple the roller assembly to the slot formed in the frame member such that the rod is adapted to be fixed at different locations along the length of the frame member as well as transversely relative to the length thereof, the coupling means further allowing the rod end to pivot about a rod axis transverse to the frame member so that the angle of the roller assembly can be selectively changed and fixed by the user.

2. The adjustable roller assembly as defined in claim 1, and further comprising a second roller assembly also comprising an elongate rod supporting a roller cover thereon, an end of the rod including means to adjustably couple the roller assembly to the slot formed in the frame member such that the rod is adapted to be fixed at different locations along the length of the frame member as well as transversely relative to the length thereof, the coupling means further allowing the rod end to pivot about a rod axis transverse to the frame member so that the angle of the roller assembly can be selectively changed and fixed by the user, the first and second roller assemblies adapted to engage sides of a multi-sided object.

3. The adjustable roller assembly as defined in claim 1, wherein the slot defined in the frame member is comprised of a single uninterrupted slot.

4. The adjustable roller assembly as defined in claim 1, wherein the slot defined in the frame member is comprised of multiple interrupted slots.

* * * * *